United States Patent [19]

Laubli

[11] 3,942,483

[45] Mar. 9, 1976

[54] PROCESS FOR REGULATING A STEAM GENERATOR AND A REGULATORY MEANS THEREFOR

[75] Inventor: Fritz Laubli, Winterthur, Switzerland

[73] Assignee: Sulzer Brothers Limited, Winterthur, Switzerland

[22] Filed: Mar. 20, 1975

[21] Appl. No.: 560,211

[30] Foreign Application Priority Data

Mar. 22, 1974 Switzerland ..... 3996/74

[52] U.S. Cl. ..... 122/448 R; 122/448 S; 122/451 S

[51] Int. Cl.[2] ..... F23N 5/00; F22B 35/06

[58] Field of Search ..... 122/406 S, 448 R, 448 S, 122/451 R, 451 S

[56] References Cited

UNITED STATES PATENTS

| | | | |
|---|---|---|---|
| 2,804,851 | 9/1957 | Smoot | 122/448 |
| 3,164,136 | 1/1965 | Laubli | 122/448 X |
| 3,202,136 | 8/1965 | Hottenstine | 122/448 |

*Primary Examiner*—Kenneth W. Sprague
*Attorney, Agent, or Firm*—Kenyon & Kenyon Reilly Carr & Chapin

[57] ABSTRACT

The steam generator which may be a forced-flow type, a drum boiler type or exhaust-gas type has at least one of the operational magnitudes, i.e. firing intensity, feedwater flow rate, gas flow rate and the like, regulated in accordance with temperature variations in the region of the economiser. The temperature variation is subjected to a retardation and the resulting signal is superimposed on the control signal (L) for the operating magnitude.

8 Claims, 1 Drawing Figure

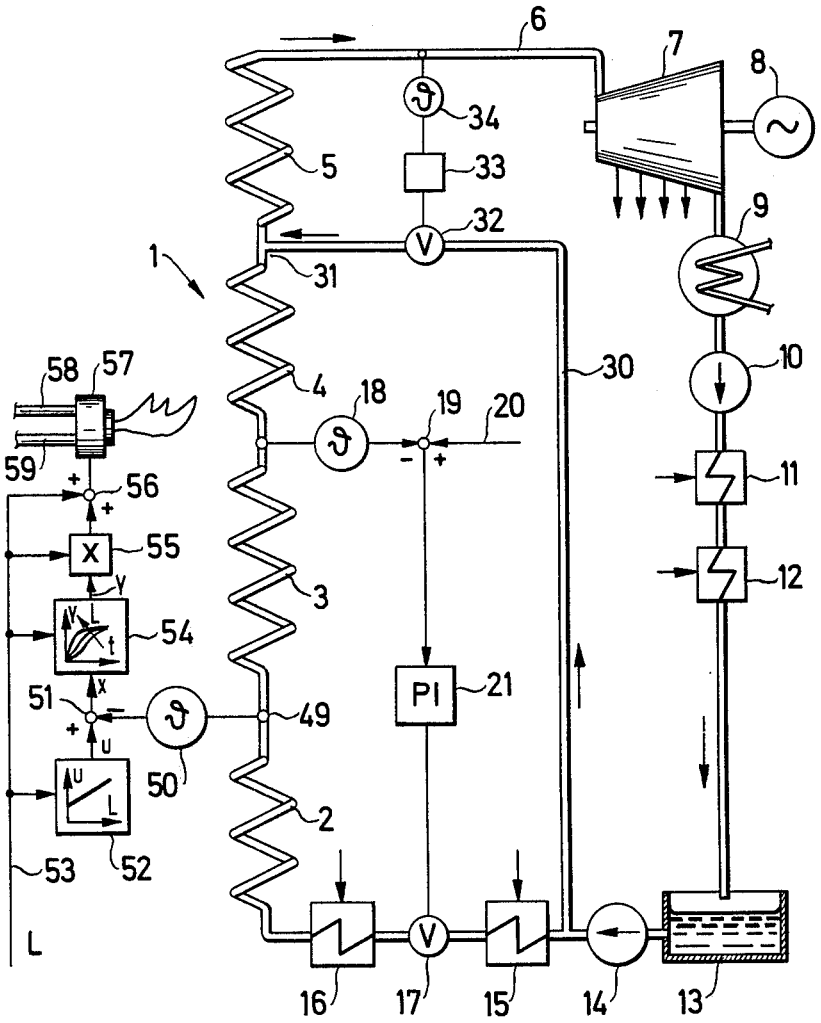
6
7
8
34
33
5
32
9
1
31
30
10
58
57
4
18
19
20
59
56
11
55
12
3
54
21
51
49
50
2
53
52
L
16
17
15
14
13

PROCESS FOR REGULATING A STEAM GENERATOR AND A REGULATORY MEANS THEREFOR

This invention relates to a process for regulating a steam generator and to a regulatory means therefor.

As is known, steam generators have been controlled by regulation of one or more of their operational magnitudes, such as the firing intensity of feed water flow rate, by means of a control signal substantially proportional to the boiler load. In some instances, the temperature of the working medium has been measured between a final high-pressure feed-water preheater and a superheater and a corresponding measurement signal formed. This measurement signal has then been superposed on the control signal or on another control signal controlling at least one other operational magnitude.

In the case of one known arrangement of this kind, in the event of a fire or feed-water derangement, the measured signal rapidly influences the fire intensity and/or the feedwater supply. Through this, temperature variations at the outlet from the superheater are damped through anticipatory action, so that the regulation of the live-steam temperature is facilitated usually by some action on the fire or by a water-injection at the superheater.

In steam generators having feed-water preheaters, the enthalpy of the feed-water at the entry into the economiser may vary considerably. A distinction must therefore be made between a static variation of the economiser inflow temperature as a definite function of the load on the one hand, and a transient, i.e. temporary, time-dependent variation on the other hand. A transient variation may be caused by starting or stopping of the boiler-installation, by an abrupt change of load, or else through a switch-on or switch-off failure of one or more preheaters. Because of the great inert mass of the boiler and the use of numerously provided temperature-regulation devices, such inflow-temperature derangements do not usually occur.

The use of liberally-dimensioned injection devices in the region of the superheater makes it possible to easily catch only slow-acting derangements at the boiler end. However, liberally dimensioned injection devices are not only expensive, but they also diminish the sensitivity of the regulation. Further, while the drawback of lower sensitivity is often countered by a cascade arrangement in which one or more upstream preinjectors, or even the boiler feed, are brought into action as soon as the valve of the last injection device exceeds a certain regulatory range, such cascade hookups are also expensive.

Accordingly, it is an object of the invention to eliminate in a simple way the effect of derangements of the inflow temperature in a steam generator without introducing the drawbacks of the known remedies or an occurrence of secondary derangements.

It is another object of the invention to eliminate any time-lagged derangement occurring at a boiler end by a variation in inflow temperature.

It is another object of the invention to regulate a steam generator in accordance with dynamic characteristics.

Briefly, the invention provides a process for regulating a steam generator by controlling at least one operational magnitude of the steam generator as well as a regulatory means.

In accordance with the process, a steam generator having a final high-pressure feed-water preheater, an economiser, an evaporator and a superheater for the flow of a working medium and in which a control signal is imposed on at least one of the operating magnitudes is regulated by measuring the temperature of the working medium at a point in the region of the economiser to form a corresponding measurement signal. This signal is then compared with a load dependent value signal corresponding to the steady mean proper value of the working medium temperature at the measurement point to form a difference signal. At least one of the measurement signal and difference signal is retarded in a retardation means of at least first order. Thereafter, the difference signal is superimposed on the control signal in order to control the operational signal in response to variations in temperature at the measuring point.

In accordance with the process, any time-lagged derangement occuring at the boiler end due to a variation of the inflow temperature is eliminated by a controlling action. Here, the essential feature is that the temperature-measurement signal comes from a point in the boiler where an influence on the fire is not appreciably affected retroactively by the control action; i.e. at the latest before entry to the radiant-heat surfaces. Thus, the process of the invention differs substantially from the prior art mentioned above where the temperature-measuring point is located in the region of the evaporator. In great contrast to the known disturbance-magnitude hook-ups, the measured signal does not act directly, but over a retardation means on the operational magnitude the signal influences. The process differs from the ordinary regulation chiefly in that the desired value corresponds to the statically adjusting mean value of the measurement, and in that practically no reaction occurs which corresponds to a closed regulatory circuit.

The regulatory means of the invention cooperates in combination with a steam generator having a final high-pressure feed-water preheater, an economiser, an evaporator and a superheater disposed in series relative to a flow of working medium, a burner and means for imposing a control signal on at least one of the preheater and burner. The regulatory means includes a temperature sensor for measuring the temperature of the working medium at a point in the region of the economiser to form a corresponding measurement signal, a desired-value means for emitting a load-dependent signal corresponding to the load on the steam generator and a comparison means for comparing the measurement and load-dependent signals to produce a difference signal in response to deviations between the two signals. A retarding means of at least first order is also provided for receiving and retarding at least one of the measurement and difference signals. In addition, a means is provided for superimposing the difference signal, after retarding is performed, on the control signal in order to correct the control signal for the operating magnitude.

The retardation means is constructed so that the retarded signal is shortened with increasing load. The correction is, thus, better adapted to the dynamic characteristics of the boiler.

A multiplier is also incorporated in the regulatory means to multiply the difference signal by the load signal downstream of the retarding means and prior to superimposition on the control signal. When the difference signal, prior to superimposition on the control signal, is multiplied by the load signal which is substantially proportional to the boiler load, a special advantage occurs in the case of boilers whose load often varies widely.

These and other objects and advantages of the invention will become more apparent from the following detailed description and appended claims taken in conjunction with the accompanying drawing in which:

The FIGURE schematically illustrates a forced-through-flow steam generator provided with a regulatory means in accordance with the invention.

Referring to the drawing, a steam generator of the forced-through-flow type is provided with a regulatory means for regulating at least one of the operating magnitudes of the steam generator.

The steam-generator 1 includes an economiser heating surface 2, an evaporator 3, and two superheater surfaces 4, 5 disposed in series relative to a flow of working medium. The superheater surface 5 produces live-steam which flows through a conduit 6 to a turbine 7 to which a generator 8 is coupled. The turbine 7 also communicates with a condenser 9 which serves to condense the expanded steam. The condensate from the condenser 9 is forwarded, by a condensate-pump 10, through two low-pressure preheaters 11 and 12 into a feed-water tank 13, out of which the condensate is fed by means of a pump 14 over two high-pressure preheaters 15 and 16, between which a feed-water valve 17 is disposed, into the steam-generator 1. The feed-water valve 17 is influenced, over a PI regulator 21, by a thermoelement 18, whose output, at a comparison location 19, is compared with a desired value, brought in over a signal line 20. An injection line 30 is branched off between the feed-pump 14 and the first high-pressure feed water preheater 15 and runs to an injection location 31 between the superheaters 4 and 5. An injection valve 32 is interposed in this line 30 and is influenced via a regulator 33 by the live-steam temperature measured by a thermoelement 34 in the conduit 6.

The regulatory means includes a temperature sensor 50 which is connected in the connection line at a point 49 between the economiser 2 and the evaporator 3. The temperature-sensor 50 has an output which emits a measurement signal with a negative sign corresponding to the measured temperature to a comparison means 51. Also, a desired value means 52 emits a positive signal $u$ to the comparison means 51. This latter signal $u$ is a load-dependent signal and, to this end, the desired value means receives the load or control signal L from a conductor line 53 for the load signal L.

The comparison means 51 produces a difference signal $x$ in response to deviations of the measured signal from the load dependent signal $u$ and emits the signal $x$ to a retarding means 54 which has characteristics of the first to third order. The characteristic lines of the retarding means 54 vary dependent on the load and for this purpose, the retarding means 54 has an input connected with the line 53 conducting the load signal L. As shown symbolically, the retarding means 54 is constructed so that with a small load L there is a long retardation; and with a great load, there is a shorter retardation.

The retarding means 54 has an output which is connected to a multiplier 55 to conduct an output signal $y$ thereto. The multiplier 55 has an input connected to the line 53 conducting the load signal L. Thus, the received signal $y$ can be multiplied by the load signal L. The multiplier 55 outputs to an addition means 56 in which the output signal of the multiplier can be superimposed or the load signal L to form a corrected load signal (control signal) which is then emitted, for example, to a burner 57 to which fuel and/or air are supplied via respective conduits 58, 59.

The various components 2 to 21 and 32 to 34 are conventional and their operation need not be further described. The remaining components 50 to 56 operate as follows.

In steady operation, the output signal of the temperature-senser 50 corresponds to the load-dependent valve $u$ specified by the desired-value emitter 52. The signals $x$ and $y$ are thus vanishingly small, and the burner 57 is controlled directly over the line 53 by the load signal L alone.

If the working medium temperature at the inlet of the economiser 2 drops, for example because of a derangement of the preheater 16, then the temperature measured by the sensor 50 at the point 49 drops after a delay and the difference signal $x$ rises. The characteristic set at the retarding means 54 by the momentary load L produces a corresponding rise of the output signal $y$ of the retarding means with a supplementary retardation or delay. This signal $y$ is then multiplied in the multiplier 55 by the load signal L, and superposed in the addition means 56 on the load signal L. The intensity of the burner 57 thus rises, retarded, to a new value increased by some amount above the nominal value, this value being proportional to the drop in temperature measured by the sensor 50.

The retarding means 54, because of the dynamic characteristics of the steam-generator, is constructed so that the correction of the steam temperature given by the arrangement completely compensates the disturbance caused by the failure of the preheater 16.

The process has the characteristic that it rapidly compensates variations of load of a temporary nature, i.e. transient time-dependent deviations of the economiser input temperature from the corresponding static mean value.

The point 49 at which the temperature-senser 50 is disposed may also be within the economiser 2 or upstream of the economiser relative to the direction of flow of the working medium. By shifting this point upstream the fire-side disturbances become smaller, while a shift downstream reduces the cost and increases the accuracy of the retarding means 54.

Instead of acting on the burner 57, the signal of the addition means 56 may alternatively act on the feed-valve 17, which would then however not be influenced by a regulator 21 of I-character but by the load-signal L. In comparison with such a variant, the illustrated embodiment has the surprising advantage that with sudden changes of load, the flow of live steam starts more rapidly, and the pressure drop is less than without the supplementary measures described above.

It is moreover possible to influence the two operational magnitudes of fire intensity and feed-water flow simultaneously with the signal formed at the addition means 56. It is however also possible, when both operational magnitudes are influenced by the load signal L, to effect the superpositioning of the temperature signal either only in the signal path leading to the feed valve 17, or only in the signal path leading to the burner 57.

Instead of using a retarding means as described above, use may be made of a retarding means having only a characteristic of the first order. The process is not limited to forced-flow-through steam generators. For example, the process may be easily applied to drum-boilers and to exhaust-gas boilers that do not have an operational characteristic of fire intensity but rather some other magnitude, namely the quantity of gas conducted to the boiler. This magnitude is then controlled by a further control signal from the temperature-measuring point in the region of the economiser, superposed with an interposed retardation element.

What is claimed is:

1. A process for regulating a steam generator having a final high-pressure feed-water preheater, an economiser, and a superheater for the flow of a working medium and comprising the steps of imposing a control signal (L) proportional to a boiler-load on at least one operational magnitude of the steam generator, measuring the temperature of the working medium at a point in the region of the economiser to form a corresponding measurement signal, comparing said measurement signal with a load-dependent value signal (U) corresponding to the steady mean proper value of the working medium temperature at said point to form a difference signal ($x$);

retarding at least one of said measurement signal and said difference signal in a retardation means of at least first order; and thereafter superimposing the difference signal on said control signal to control the operational magnitude in response to variations in the temperature at said point in the region of the economiser.

2. A process as set forth in claim 1 wherein in said retarding step the retarded signal is shortened with increasing load.

3. A process as set forth in claim 1 which further includes the step of multiplying the difference signal by said control signal prior to superimposition on said control signal.

4. A process as set forth in claim 1 wherein the operational magnitude is selected from the group consisting of fire intensity and feed-water flow rate.

5. A process as set forth in claim 1 wherein the operational magnitude is a rate of gas flow to an exhaust-gas steam generator.

6. In combination with a steam generator having a final high-pressure feed-water preheater, an economiser, an evaporator and a superheater disposed in series relative to a flow of working medium therethrough, a burner and means for imposing a control signal on at least one operational magnitude of said preheater and said burner;

a regulatory means for controlling at least one of the rate of flow of feed-water to said preheater and the firing intensity of said burner, said regulatory means including a temperature sensor for measuring the temperature of the working medium at a point in the region of said economiser to form a corresponding measurement signal, a desired-value means for emitting a load-dependent signal corresponding to the load on said steam generator;

a comparison means for comparing said measurement signal with said load-dependent signal to produce a difference signal in response to deviations between said measurement signal and said load-dependent signal, a retarding means of at least first order for receiving and retarding at least one of said measurement signal and said difference signal, and means for superimposing the difference signal after retarding on said control signal to correct said control signal.

7. The combination as set forth in claim 6 wherein said retarding means has an input connected to said means for imposing a control signal, said retarding means having a characteristic of shortening the retardation effect with increasing load.

8. The combination as set forth in claim 6 wherein said regulatory means further includes a multiplier having an input to receive said control signal and an input to receive the difference signal downstream of said retarding means, said multiplier multiplying said received signals to produce a signal for imposition on said control signal for regulation of at least one of the rate of flow of feed-water and firing intensity.

* * * * *